US008353135B2

(12) United States Patent
Sarkisian

(10) Patent No.: US 8,353,135 B2
(45) Date of Patent: Jan. 15, 2013

(54) SEISMIC STRUCTURAL DEVICE

(75) Inventor: Mark P. Sarkisian, San Anselmo, CA (US)

(73) Assignee: Skidmore Owings & Merrill LLP, New York, NY (US)

( * ) Notice: Subject to any disclaimer, the term of this patent is extended or adjusted under 35 U.S.C. 154(b) by 0 days.

(21) Appl. No.: 12/724,967

(22) Filed: Mar. 16, 2010

(65) Prior Publication Data

US 2010/0192485 A1 Aug. 5, 2010

Related U.S. Application Data

(63) Continuation of application No. 11/752,132, filed on May 22, 2007, now Pat. No. 7,712,266.

(51) Int. Cl.
*E04H 9/02* (2006.01)
*E04B 1/98* (2006.01)

(52) U.S. Cl. ..... 52/167.3; 52/167.9; 52/573.1; 52/655.1; 52/848; 52/584.1

(58) Field of Classification Search ..... 52/167.1, 52/167.3, 167.4, 573.1, 291, 167.9, 657, 52/655.1, 584.1, 582.1, 848, 849; 403/2, 403/245, 262; 256/13.1
See application file for complete search history.

(56) References Cited

U.S. PATENT DOCUMENTS 1,536,717 A * 5/1925 Krekel ..... 52/657
1,787,167 A * 12/1930 Purdy ..... 403/58
4,409,765 A * 10/1983 Pall ..... 52/167.1
5,375,382 A * 12/1994 Weidlinger ..... 52/167.3
5,946,866 A * 9/1999 Weglewski et al. ..... 52/167.1
6,138,427 A * 10/2000 Houghton ..... 52/655.1
6,141,919 A * 11/2000 Robinson ..... 52/167.7
6,681,538 B1 * 1/2004 Sarkisian ..... 52/289
6,837,010 B2 * 1/2005 Powell et al. ..... 52/167.3
2004/0074161 A1 * 4/2004 Kasai et al. ..... 52/167.1
2004/0107654 A1 * 6/2004 Powell et al. ..... 52/167.3
2006/0101733 A1 * 5/2006 Jen et al. ..... 52/167.1
2007/0292204 A1 * 12/2007 Hackney ..... 403/93

FOREIGN PATENT DOCUMENTS

JP 02209572 A * 8/1990
WO WO 2005085543 A1 * 9/2005
WO WO 2006094911 A1 * 9/2006

* cited by examiner

*Primary Examiner* — Robert Canfield
*Assistant Examiner* — Jessie Fonseca
(74) *Attorney, Agent, or Firm* — SNR Denton US LLP

(57) ABSTRACT

A pin-fuse frame used in a frame assembly that may be subject to extreme seismic loading. The pin-fuse frame includes of columns, beams, plate assemblies that extend between columns and beams, and may included a diagonal brace. The plate assemblies are fixed to the columns and attached to the beams and brace via pin joints. A joint includes a pin connection through outer connection plates connected to a column and inner connection plates connected to a beam. Connecting rods positioned about the pin maintain a coefficient of friction until exposed to extreme seismic activity, at which time the joint accommodates a slippage of at least one of the inner and outer connection plates relative to each other rotationally about the pin. The diagonal brace is separated into two segments connected together with connection plates. These connection plates accommodate a slippage of the segments relative to each other.

8 Claims, 18 Drawing Sheets

SEISMIC STRUCTURAL DEVICE

RELATED APPLICATION DATA

This application is a continuation of U.S. patent application Ser. No. 11/752,132, filed May 22, 2007, now U.S. Pat. No. 7,712,266, the entirety of which is incorporated herein by reference to the extent permitted by law.

BACKGROUND OF THE INVENTION

1. Field of the Invention

The present invention generally relates to a braced steel frame that is utilized in a structure that is subject to seismic loads. In particular, the braced steel frame is a pin-fused frame that lengthens dynamic periods and reduces the forces that must be resisted within the frame so that the frame can withstand seismic activity without sustaining significant damage.

2. Description of the Related Art

Structures have been constructed, and are being constructed daily, in areas subject to extreme seismic activity. Special considerations must be given to the design of such structures. In addition to normal loading conditions, the walls and frames of these structures must be designed not only to accommodate normal loading conditions, but also those loading conditions that are unique to seismic activity. For example, frames are typically subject to lateral cyclic motions during seismic events. To withstand such loading conditions, structures subject to seismic activity must behave with ductility to allow for the dissipation of energy under those extreme loads.

Conventional frames subject to seismic loads typically have been designed with the beams and braces fully connected to columns either by welding or bolting or a combination of the two. Flanges of beams are typically connected to column flanges via full penetration welds. Beam webs may be either connected with full penetration welds or by bolting. Diagonal bracing members are typically connected to a joint that is welded to the beams and the columns. Diagonal braces are typically bolted to the joints; however, welding is also used.

Braced frames have been used extensively in structures that resist lateral loads due seismic events. In addition, the use of moment-resisting frames in taller structures may not be feasible since the required stiffness may only be achievable with large structural members that add to the amount of material required for the structure and therefore cost. These frames provide an efficient means of achieving the appropriate stiffness, however provide questionable ductility when subjected to cyclic loadings. Since structural members are typically subjected to primarily axial loads with minimal bending, the material required to resist forces is usually low.

These conventional frames may be designed to have bracing members that resist only tension or that resist both tension and compression. Since ductility is limited in these frames, building codes, such as the Uniform Building Code (UBC), have limitations to their use. Tension-only braced frames (diagonal members only capable of resisting tensile loads) for occupied structures are limited by code to a height of 65 feet. In recognition of limited system ductility in this design, the recommended R-Factor for this system is 2.8 compared to 8.5 in a special moment-resisting frame (the higher the R-Factor the higher the potential system ductility in a seismic event).

Further, conventional braced frames that resist both tension and compression provide questionable ductility when subjected to cyclic seismic loading. The braces in these frames typically buckle and in some cases fracture when further subjected to tension and compression loads. For instance, in accordance with building codes, specifically the Uniform Building Code (UBC), braced frames capable of resisting both tension and compression are limited to a height of 160 feet for ordinary braced frames and 240 feet for special concentrically braced frames. In recognition of limited system ductility in design, the recommended R-Factor for ordinary braced frames is 5.6 and for special concentrically braced frames is 6.4, compared to 8.5 in a special moment-resisting frame. Eccentrically braced frames are designed to have the horizontal "linking" member inelastically deform during an extreme seismic event. This ductility for this frame is recognized by the UBC by recommending an R-Factor=7.0. The permanent deformation of the links within these frames raises serious questions about the structure's capability of resisting further seismic events without repair or replacement.

Recent testing of braced frames, particularly steel concentric braced frames (CBF), indicates that many commonly used members and brace configurations do not meet seismic performance expectations. Net member section properties, section type, width-thickness ratio of the member cross section, and member slenderness affect the ductility of the braces. This was shown through the research of Mahin and Uriz and documented in the "Seismic Performance Assessment of Concentrically Braced Steel Frames", Proceedings of the $13^{th}$ World Conference of Earthquake Engineering, 2004.

Considerable research has been performed considering the performance of braced frames, and developments of braced systems have been made that allow for inelasticity to occur in a prescribed location. Such systems include Buckling Restraint Braced Frames (BRBF), where devices are inserted in the braces allowing for inelasticity to occur in localized areas, typically at the ends of the brace. After a severe seismic event, these devices protect the diagonal member from uncontrolled buckling, but the braces must be removed and replaced to provide for future integrity of the structure. These braces are manufactured and supplied by Nippon Steel Corporation, Core-Brace Systems, and others.

Frames without diagonal braces provide additional ductility but with far less stiffness. Moment-resisting frame systems prove effective in resisting lateral loads when the frames are designed for the appropriate loads and the connections are detailed properly. In recent seismic events, including the Northridge Earthquake in Northridge, Calif., moment-resisting frames within structures that used welded flange connections successfully prevented buildings from collapsing but these frames sustained significant damage. After being subject to seismic loads, most of these types of moment-resisting frames have exhibited local failures of connections due to poor joint ductility. Such frames with such non-ductile joints have raised significant concerns about the structural integrity and the economic performance of currently employed moment-resisting frames after being subject to an earthquake.

Since the Northridge Earthquake, extensive research of beam-to-column moment connections has been performed to improve the ductility of the joints subject to seismic loading conditions. This research has lead to the development of several modified joint connections, one of which is the reduced beam section connection ("RBS") or "Dogbone." Another is a slotted web connection ("SSDA") developed by Seismic Structural Design Associates, Inc. While these modified joints have been successful in increasing the ductility of the structure, these modified joints must still behave inelastically to withstand extreme seismic loading. It is this inelasticity, however, that causes joint failure and in many cases causes the joint to sustain significant damage. Although the amount of dissipated energy is increased by increasing the ductility, because the joints still perform inelastically, these conventional joints still tend to become plastic or yield when subject to extreme seismic loading.

Although current frames may resist seismic events and prevent collapse, the damage caused by the members and joints inability to function elastically, raises questions about whether structures that use these conventional designs can remain in service after enduring seismic events. A need therefore exists for frames that can withstand a seismic event without experiencing significant inelasticity or failure so that the integrity of the structure remains relatively undisturbed even after being subject to seismic activity.

SUMMARY OF THE INVENTION

A "pin-fuse frame" consistent with the present invention enables a building or other structure to withstand a seismic event without experiencing significant inelasticity or structural failure at the pin-fuse frame. The pin-fuse frame may be incorporated, for example, in a beam and column frame assembly of a building or other structure subject to seismic activity. The pin-fuse frame improves a structure's dynamic characteristics by allowing the joints to slip under extreme loads. This slippage changes the structure's dynamic characteristics by lengthening the structure's fundamental period and essentially softening the structure, allowing the structure to exhibit elastic properties during seismic events. By utilizing the pin-fuse frame, it is generally not necessary to use frame members as large as those typically used for a similar sized structure to withstand an extreme seismic event. Therefore, building costs can also be reduced through the use of the pin-fuse frame consistent with the present invention.

The pin-frame frame provides for one or more "fuses" to occur within the structure. In a first embodiment, diagonal members within the frame may slip at a prescribed force level caused by the seismic event. Ends of beam members may not slip in rotation and this level of force. In another embodiment, as forces levels increase, the beam end may then slip or rotate. In addition, these behaviors occur in the structure in areas of highest demand. Therefore, some diagonal and beam members may not slip in a seismic event. In each case, the system is designed to protect the columns from inelastic deformations or collapse.

The frame may have one, two, or more diagonals. A single diagonal may be sloped in either direction. Two diagonals may be configured to form an x-brace or to form a chevron brace. Multiple diagonal braces could also be used to stiffen the frame. The frame may be configured without any diagonal braces, resulting in a moment-resistance frame.

The pin-fuse frame may be employed in a frame where the beams and diagonal members (i.e., braces) attach to columns. Rather than attaching directly to the columns, plate assemblies may be welded to the columns and extend therefrom for the attachment of the beams and the braces. A fused joint may also be introduced into a central portion of the brace with a plate assembly. The pin-fuse frame may include one or more plate assemblies associated with the beam ends and/or within the diagonals. To create the joints at the ends of the beams, plate assemblies associated with the beams are designed to mate and be held to together by a pipe/pin assembly extending through connection plates that extend outward from the beams and columns. The end of the diagonals incorporate a single pipe/pin assembly. Additionally, the plate assemblies at the beam ends have slots arranged, for example, in a circular pattern. The plate assemblies within the diagonals have slots parallel to the member. The plate assemblies at the beam end and within the diagonals are secured together, for example, with torqued high-strength steel bolts that pass through the slots.

The bolted connection in the diagonals allow for the diagonals to slip relative to the connection plates (either in tension or compression) when subjected to extreme seismic loads without a significant loss in the bolt clamping force. The bolted connections in the beam ends allow the beams to rotate and slip relative to the connection plates when subjected to extreme seismic loads without a significant loss in the bolt clamping force. Movement in the joints is further restricted by treating the faying surfaces of the plate assembly with brass or similar materials. For example, brass shims that may be used within the connections possess a well-defined load-displacement behavior and excellent cyclic attributes.

The friction developed from the clamping force within the plate assembly with the brass shims against the steel surface prevents the joint from slipping under most service loading conditions, such as those imposed by wind, gravity, and moderate seismic vents. The high-strength bolts are torqued to provide a slip resistant connection by developing friction between the connected surfaces. However, under extreme seismic loading conditions, the level of force applied to the connections exceeds the product of the coefficient of friction times the normal bolt clamping force, which causes the joint to slip along the length of the diagonal members and the joints to rotate at the beam ends while maintaining connectivity.

The sliding of the joint in the diagonal and the rotation of the joints in the beams during seismic events provides for the transfer of shear forces and bending moment from the diagonals and the beams to the columns. This sliding and rotation dissipates energy, which is also known as "fusing." This energy dissipation reduces potential damage to the structure due to seismic activity.

Although the pin-fuse frame joints consistent with the present invention will slip under extreme seismic loads to dissipate energy, the joints will, however, remain elastic due to their construction. Furthermore, no part of the joint becomes plastic or yields when subjected to the loading and the slip. This allows frame structures utilizing the joint construction consistent with the present invention to remain in service after enduring a seismic event and resist further seismic activity.

In connection with a joint connection consistent with the present invention, a joint connection is provided that comprises:

a first plate assembly connected to a structural column and having a first connection plate including a first inner hole formed therethrough and a plurality of first outer holes formed therethrough about the first inner hole;

a second plate assembly connected to a structural beam and having a second connection plate including a second inner hole formed therethrough and a plurality of second outer holes formed therethrough about the second inner hole, the second connection plate being position such that at least a portion of the first inner hole aligns with at least a portion of the second inner hole and at least a portion of each of the first outer holes aligns with at least a portion of a corresponding second outer hole, at least one of the plurality of first outer holes and the plurality of second outer holes being slots aligned radially about the respective first inner hole or second inner hole;

a pin positioned through the first inner hole and the second inner hole rotationally connecting the first plate assembly to the second plate assembly; and at least one connecting rod position through at least one of the first outer holes and corresponding second outer holes, the joint connection accommodating a slippage of at least one of the first and second plate assemblies relative to each other rotationally about the pin when the joint connection is subject to a seismic load that overcomes a coefficient of friction effected by the at least one connecting rod and without losing connectivity at the pin.

In connection with a joint connection consistent with the present invention, a joint connection is provided that comprises:

a brace positioned diagonally between two columns of a structural frame, the brace having a first portion and a second portion that is separated from the first portion, the first portion having a first portion connection plate having at least one first hole formed therethrough, the second portion having a second portion connection plate having at least one second hole formed therethrough;

a connecting plate having at least a third hole and a fourth hole formed therethrough, the third hole aligned with the first hole of the first portion and the fourth hole aligned with the second hole of the second portion, the holes in at least one of the group of the first hole and the second hole and the group of the third hole and the fourth hole being slots aligned in a direction of the first and second portions;

a first pin positioned through the first hole and the third hole connecting the first portion to the connecting plate; and a second pin positioned through the second hole and the fourth hole connecting the second portion to the connecting plate, the joint connection accommodating a slippage of at least one of the first and second portions relative to each other when the joint connection is subject to a seismic load.

In connection with a pin-fuse frame consistent with the present invention, a pin-fuse frame is provided that comprises:

a first joint connection including a first plate assembly connected to a structural column and having a first connection plate including a first inner hole formed therethrough and a plurality of first outer holes formed therethrough about the first inner hole;

a second plate assembly connected to a structural beam and having a second connection plate including a second inner hole formed therethrough and a plurality of second outer holes formed therethrough about the second inner hole, the second connection plate being position such that at least a portion of the first inner hole aligns with at least a portion of the second inner hole and at least a portion of each of the first outer holes aligns with at least a portion of a corresponding second outer hole, at least one of the plurality of first outer holes and the plurality of second outer holes being slots aligned radially about the respective first inner hole or second inner hole;

a pin positioned through the first inner hole and the second inner hole rotationally connecting the first plate assembly to the second plate assembly, at least one connecting rod position through at least one of the first outer holes and corresponding second outer holes, the first joint connection accommodating a slippage of at least one of the first and second plate assemblies relative to each other rotationally about the pin when the first joint connection is subject to a seismic load that overcomes a coefficient of friction effected by the at least one connecting rod and without losing connectivity at the pin; and a second joint connection including a brace positioned diagonally between two columns of a structural frame, the brace having a first portion and a second portion that is separated from the first portion, the first portion having a first portion connection plate having at least one first hole formed therethrough, the second portion having a second portion connection plate having at least one second hole formed therethrough; and a connecting plate having at least a third hole and a fourth hole formed therethrough, the third hole aligned with the first hole of the first portion and the fourth hole aligned with the second hole of the second portion, the holes in at least one of the group of the first hole and the second hole and the group of the third hole and the fourth hole being slots aligned in a direction of the first and second portions;

a first pin positioned through the first hole and the third hole connecting the first portion to the connecting plate; and a second pin positioned through the second hole and the fourth hole connecting the second portion to the connecting plate, the second joint connection accommodating a slippage of at least one of the first and second portions relative to each other when the second joint connection is subject to the seismic load.

Other features of the invention will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in an constitute a part of this specification, illustrate an implementation of the invention and, together with the description, serve to explain the advantages and principles of the invention. In the drawings.

FIGS. 2B-2D depict diagonal brace configurations that are consistent with the present invention.

Corresponding reference characters indicate corresponding parts throughout the several views of the drawings.

DETAILED DESCRIPTION OF THE INVENTION

Reference will now be made in detail to an implementation in accordance with a pin-fuse frame consistent with the present invention as illustrated in the accompanying drawings. A pin-fuse frame consistent with the present invention enables a building or other structure to withstand a seismic event without experiencing significant inelasticity or structural failure at the pin-fuse frame. The pin-fuse frame may be incorporated, for example, in a beam and column frame assembly of a building or other structure subject to seismic activity and improves a structure's dynamic characteristics by allowing the joints to slip under extreme loads. This slippage changes the structure's dynamic characteristics by lengthening the structure's fundamental period and essentially softening the structure, allowing the structure to exhibit elastic properties during seismic events. By utilizing the pin-fuse frame, it is generally not necessary to use frame members as large as those typically used for a similar sized structure to withstand an extreme seismic event. Therefore, building costs can also be reduced through the use of the pin-fuse frame consistent with the present invention.

Figure 1A:
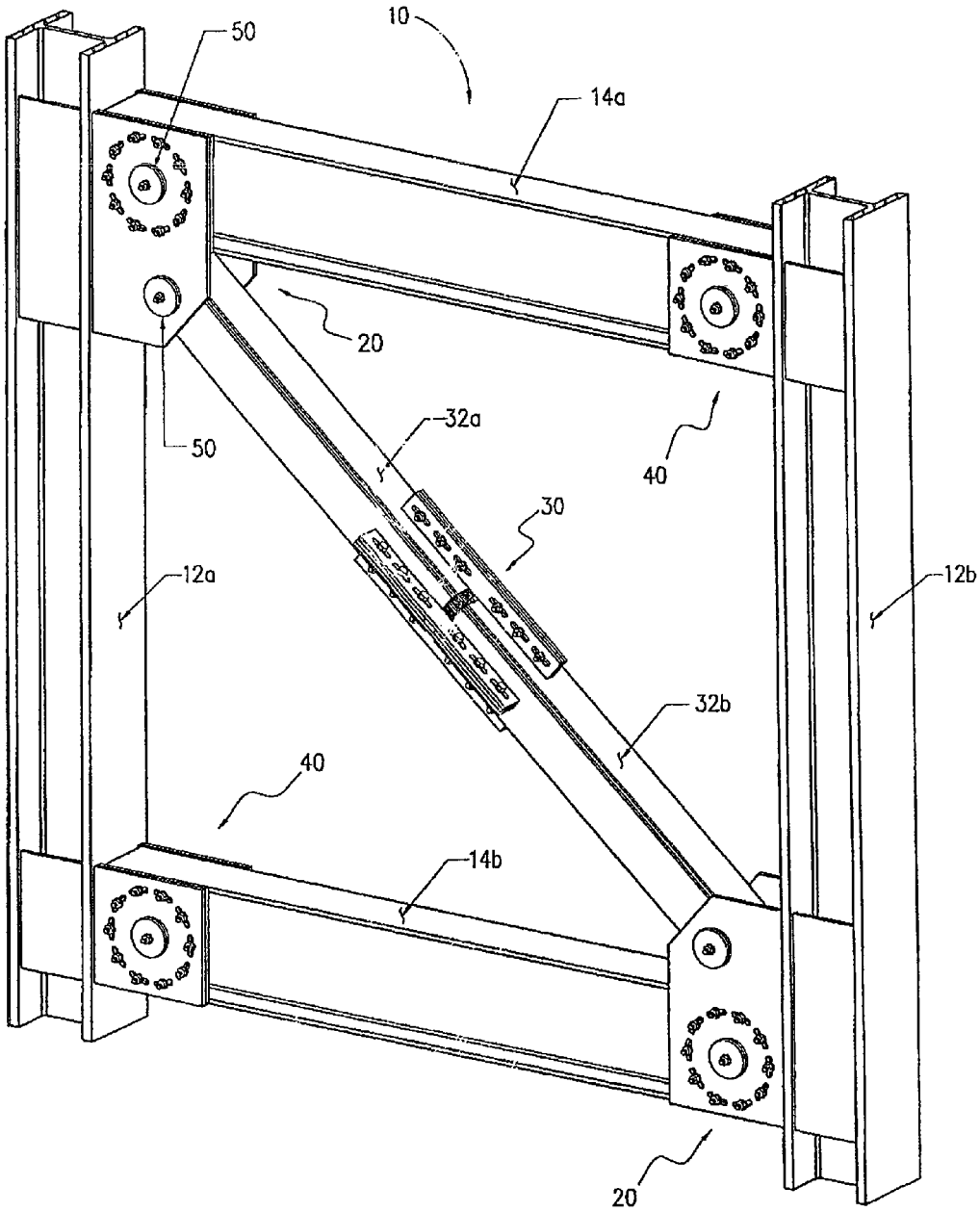
FIG. 1 is a perspective view of one embodiment of a pin-fuse frame assembly consistent with the present invention.
Figure 1B:
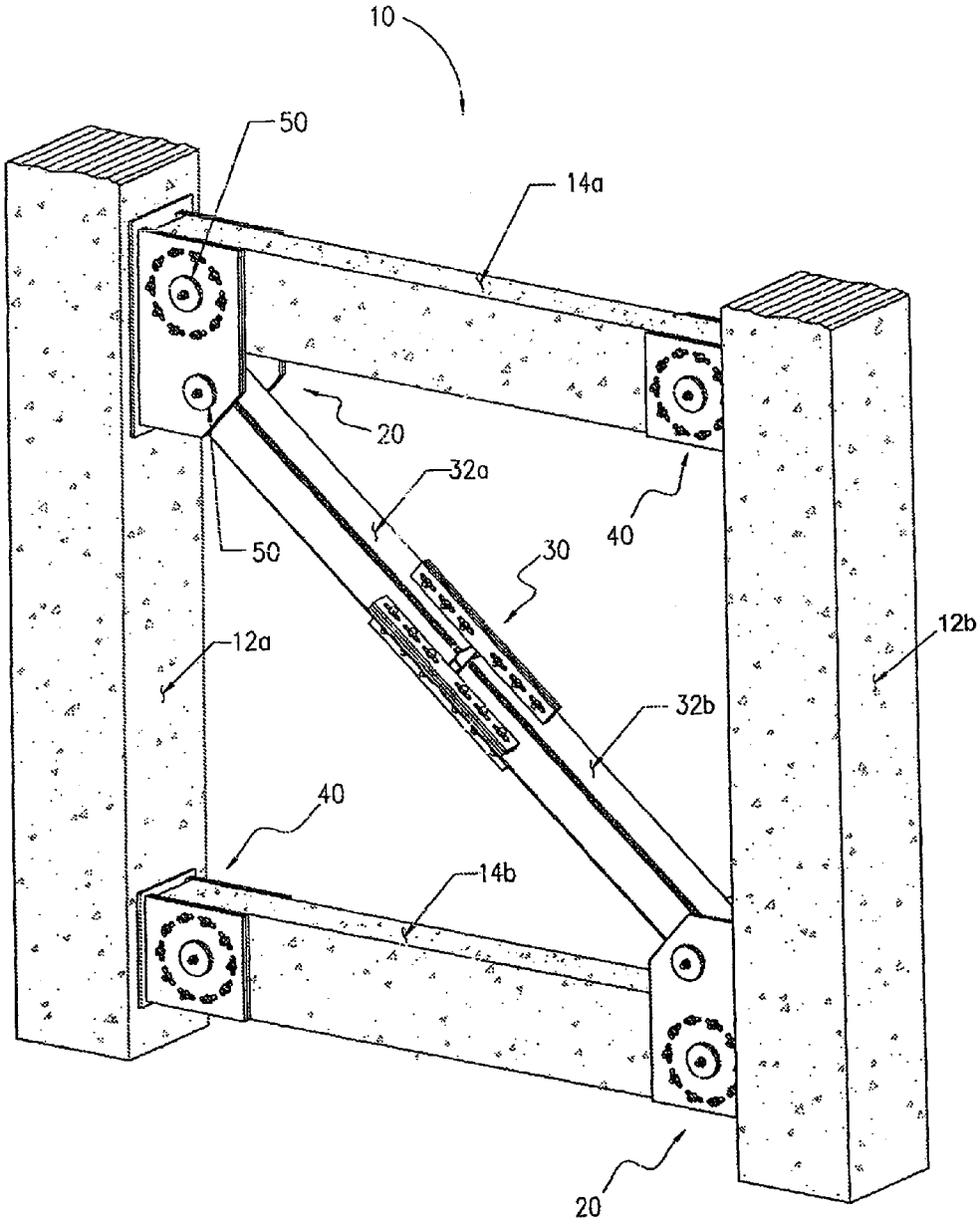

FIG. 1 is a perspective view of an illustrative pin-fuse frame assembly 10 consistent with the present invention. As seen in FIG. 1, the illustrative pin-fuse frame assembly 10 includes columns 12*a* and 12*b* attached to beams 14*a* and 14*b* and a brace assembly that includes braces 32*a* and 32*b* via plate assemblies 20 and 40 that extend from the columns 12*a* and 12*b*. In the illustrative example, the columns, beams, braces, and plate assemblies comprise structural steel. One having skill in the art will appreciate that the components may comprise alternative or additional materials, such as reinforced concrete, composite materials, e.g., a combination of structural steel and reinforced concrete, and the like. The pin-fuse frame may be used between reinforced concrete walls within a shear wall structure and the like. Therefore, all the conditions described herein are appropriate for these conditions.

This view illustrates the beams 14*a* and 14*b* and braces 32*a* and 32*b* connected to columns 12*a* and 12*b*. The beams are connected to the columns with plate assemblies 20 and 40. The braces are connected to the columns with plate assemblies 20. The braces are connected together with a plate assembly 30.

Figure 2A:
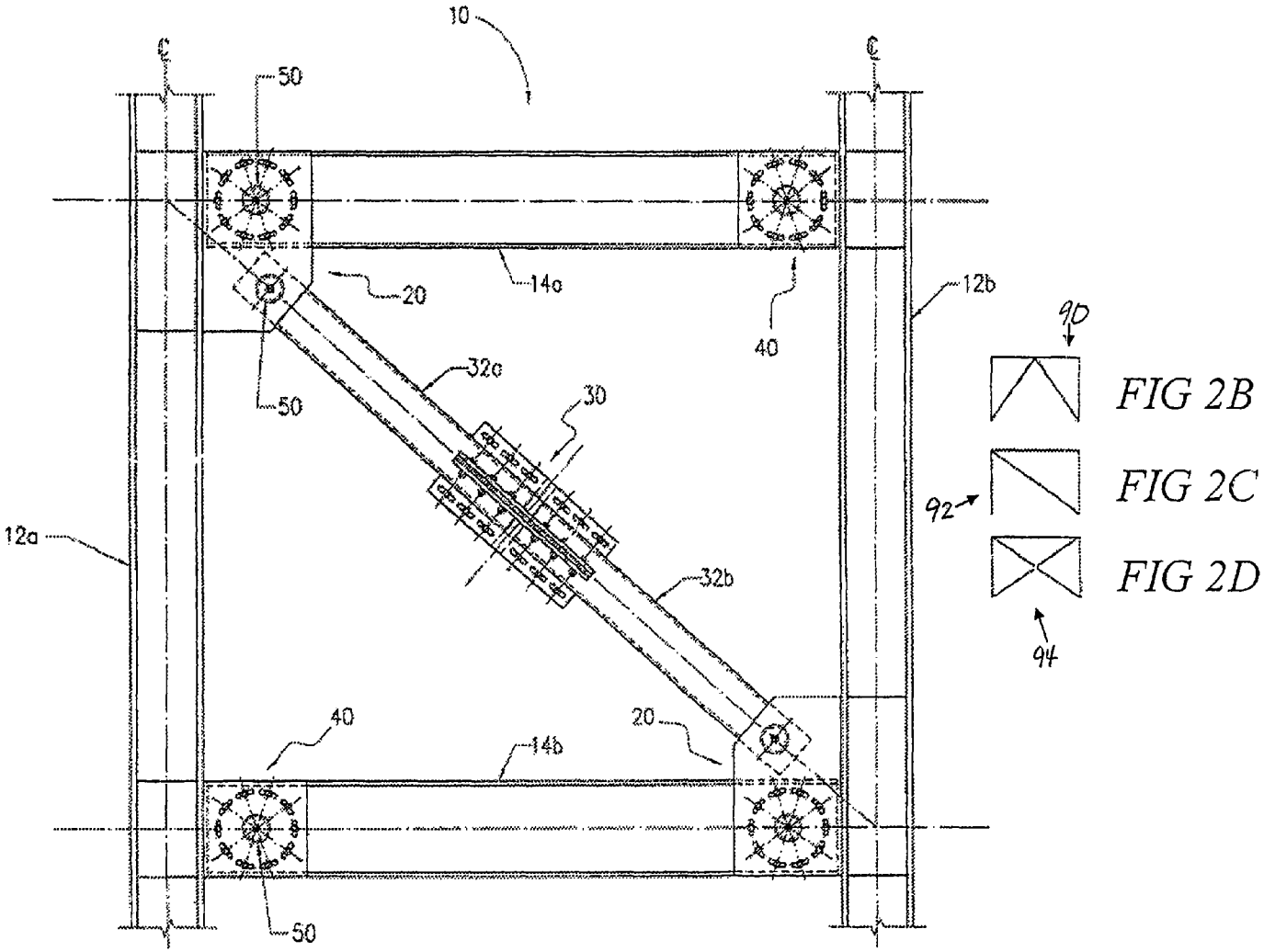
FIG. 2*a* is a front view of the pin-fuse frame assembly illustrated in FIG. 1.

In the illustrative example, the steel plate assemblies 20 and 40, which are also referred to as joints herein, are welded directly to the columns 12*a* and 12*b*. These may be connected to the columns in a different manner, such as via bolts, and the like. Further, although the perspective view shown in FIG. 1 is specific to a single diagonal braced configuration, many brace conditions could exist including, but not limited to, those shown in brace configurations 90, 92 and 94 of FIGS. 2*a*, 2*b* and 2*c*. The beams 14*a* and 14*b* and braces 32*a* and 32*b* attach to the plate assemblies 20 and 40 via pin assemblies 50.

As will be described in more detail below with reference to the Figures, to create the plate assemblies 20 and 40, connection plates 24 and 18 are connected to each other via a structural steel pin assembly 50 that extends through two sets of twin connection plates 24 and 18. Connection plates 24 are connected to the braces 32*a* and 32*b* via a pin assembly 50 that extends through the connection plates 24 and the braces 32*a* and 32*b*. Each set of inner plates 18 and braces 32*a* and 32*b* and outer plates 24 abut against one another when the joint 20 is complete. To create the pin-fuse joint assemblies 40, connection plates 44 and 18 are connected to each other via a pin assembly 50 that extends through two sets of twin connection plates 24 and 18. Each set of inner plates 18 and outer plates 24 abut against one another when the joint 40 is complete. The joint assembly 30 connects to braces 32*a* and 32*b* to create a fuse assembly. Connection plates 34 and 35 connect to plates 36 and 38 respectively. East set of inner plates 34 and 35 and outer plates 36 and 38 abut against each other when the joint 30 is complete. As further described below, connecting the beams 14*a* and 14*b* and the braces 32*a* and 32*b* and plate assemblies 20, 30, and 40 creates the pin-fuse frame 10 consistent with the present invention.

Figure 3:
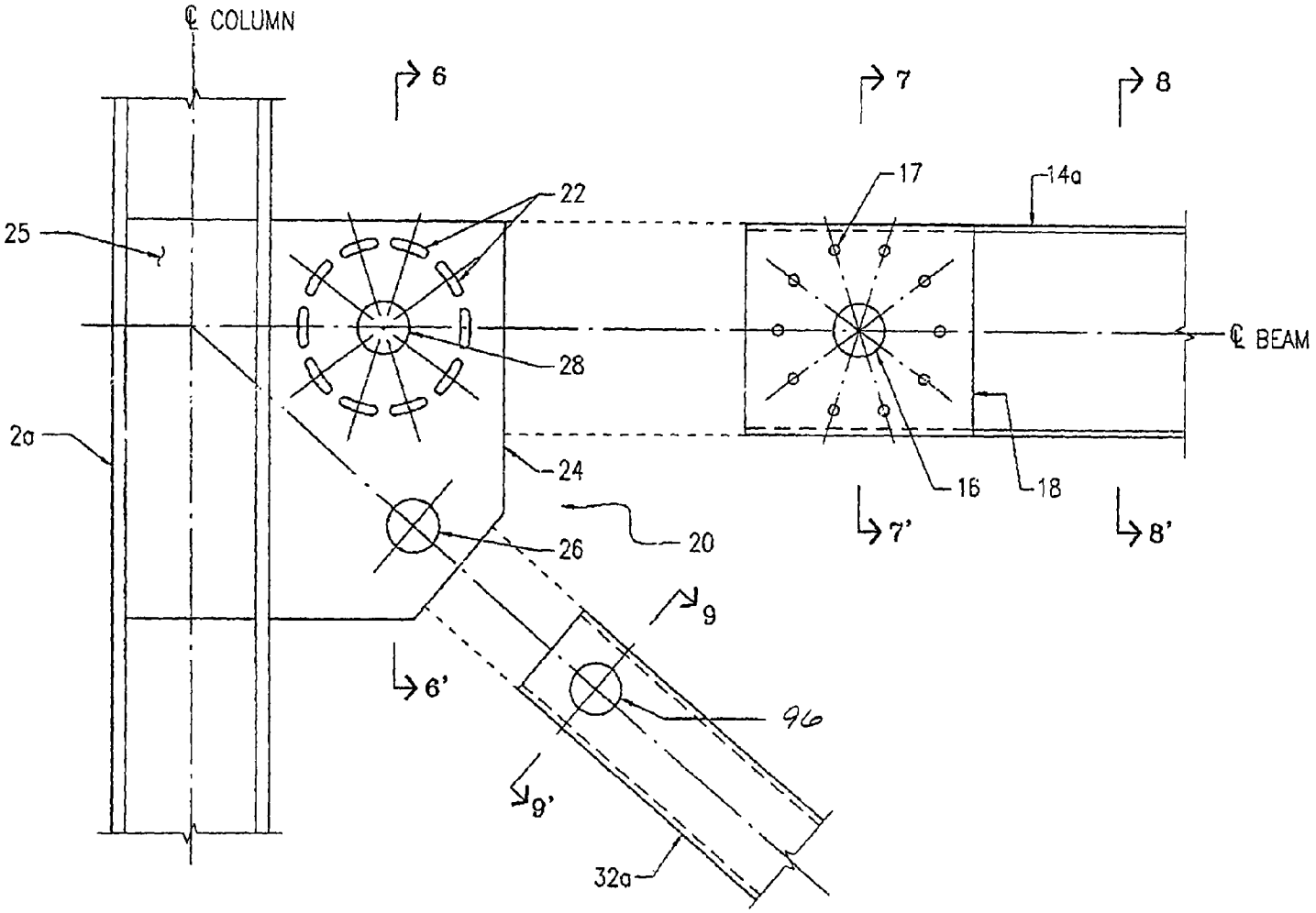
FIG. 3 is an exploded front view of the beam-to-brace-to-column connection assembly illustrated in FIG. 1.

FIG. 3 is an exploded front view of one of the plate assemblies 20 illustrated in FIG. 1. This view illustrates the connection plate 24, beam 14*a*, and brace 32*a* as they would appear when the joint 20 is disconnected. Connection plates 24 are welded to column 12*a*. Stiffener plates 25 are welded to the column flanges and align with connection plates 24. Connection plates 18 are welded to the flanges of beam 14*a* Inner hole 16 and outer hole 17 included in connection plates 18 and inner hole 28 and outer holes 22 included in connection plates 24 allow for placement of a pin assembly 50. In the illustrative example, the outer holes 22 are long slotted holes with a radial geometry. Alternatively, holes 17 may be slot shaped and holes 22 may be circular, or both holes 17 and 22 may be slot shaped. The outer holes 17 and outer holes 22 are aligned for the installation of connecting rods 70, such as high strength bolts and the like. The diagonal brace 32*a* includes a hole 96 that aligns with hole 26 in connection plate 24 that accepts a pin assembly 50.

Figure 3A:
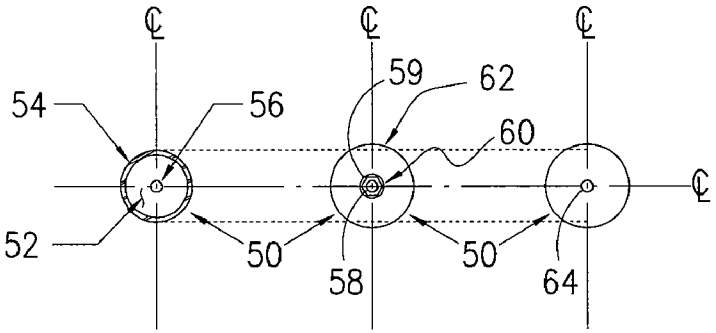
FIG. 3*a* is a front view of a pipe/pin assembly and web stiffener used to connect the moment resisting beam and the brace to the plate assembly.

FIG. 3*a* is a front view of the pipe or pin assembly 50 with a web stiffener 52 used to create a pin connection between the beams 14*a* and 14*b* and plate assemblies 20 and 40 and to create a pin connection between the diagonal braces 32*a* and 32*b* and the plate assembly 20. As shown in FIG. 3*a*, the illustrative pipe/pin assembly 50 includes a structural steel pipe 54, two cap plates 62 and a steel bolt 60. The steel pipe 54, with the steel web stiffener 52, is inserted into the inner hole 16 in the beam 14*a* and 14*b* connection plates 18, into the circular hole 24 in the diagonal braces 32*a* and 32*b*, and into circular holes 26, 28, and 48 in connection plates 24 and 44. The structural steel pipe 54 is then laterally restrained in the beams 14*a* and 14*b* and the braces 32*a* and 32*b* by two steel keeper or cap plates 62, one plate 62 positioned on each side of the pipe 54. These keeper or cap plates 62 are fastened together with a torqued high-strength bolt 60. The bolt 54 is aligned through a hole 64 in both pipe cap plates 62 and through the hole 56 in the web stiffener 52. Steel washers 59 are used under the bolt head 58 and under the end nut 63 (see FIG. 4*a*), which construction may be used for all the torqued high-strength bolts used in the pin-fuse frame joints 20, 30, and 40.

Figures 4, 4A:
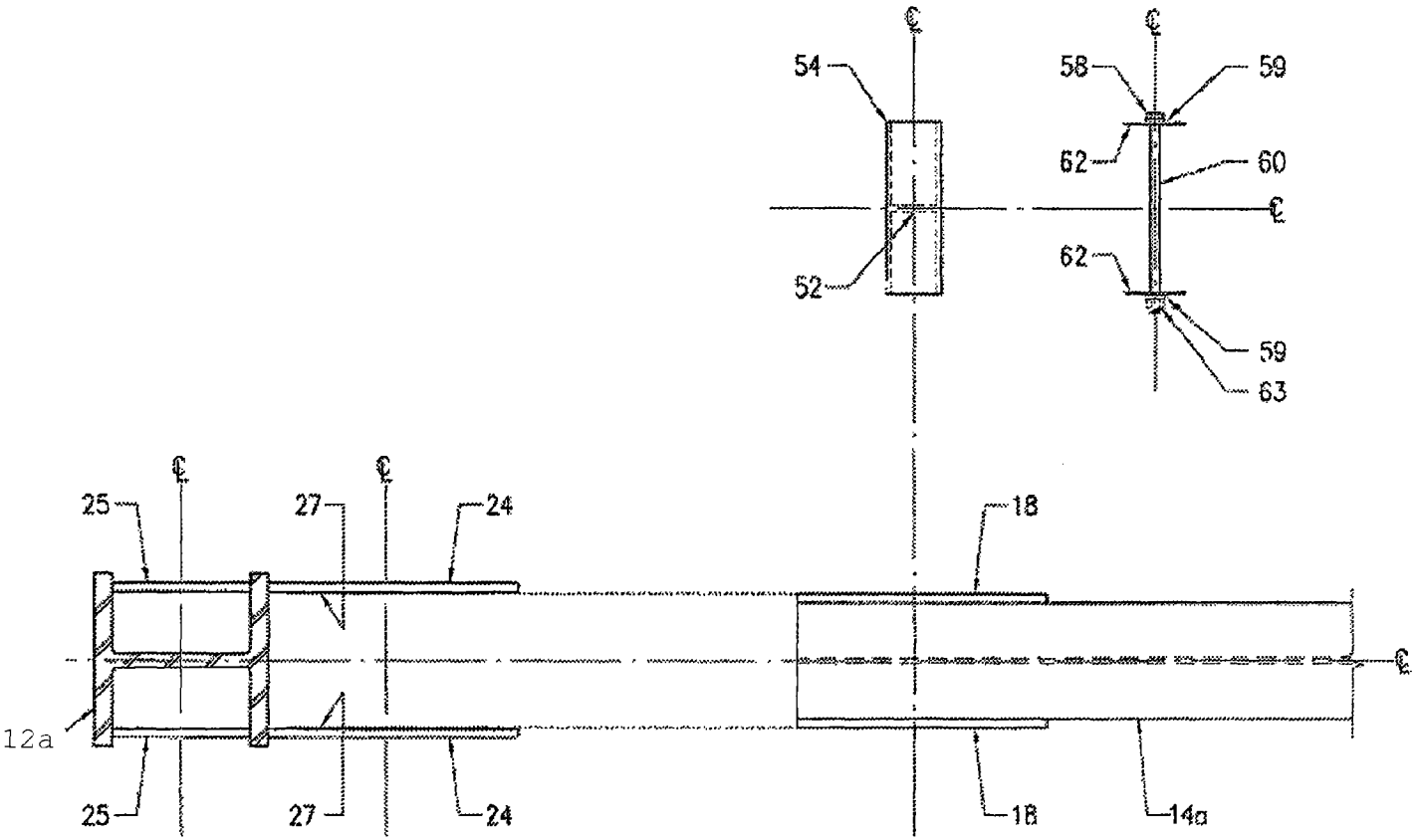
FIG. 4 is and exploded top view of the beam-to-column joint assembly illustrated in FIG. 1.
FIG. 4*a* is a side view of the pipe/pin assembly and the web stiffener used to connect the beam to the plate assembly.

FIG. 4 is an exploded top view of the pin-fuse frame 10 illustrated in FIG. 1 specifically illustrating the beam-to-column connection at one of the joint assemblies 20. This view illustrates the placement of connection plates 24 and beam end connection plates 18. As shown in FIG. 4, the connection plates 24 extend outward from the column 12*a* flanges and connection plates 18 connect beam 14*a* flanges. In the illustrative example, the connection plates 24 and 18 are placed equidistant from one another relative to the center line of the plate assembly.

In the illustrative example, one connection plate 24 is positioned on each side of the connection plates 18 when the plate assembly 20 and the beam 14*a* are joined. Stiffener plates 25 are aligned with connection plates 24 and are located in the web of the column 12*a*. Shims 27, such as brass shims, may be located between plates 24 and 18. Connection plates 24 and stiffener plates 25 may be welded directly to column 12*a* and connection plates 18 may be welded directly to beam 14*a*. Alternatively, the connection plates 18 and 24 may be connected to the respective beam or column by an alternative connection, such as using bolts and the like.

Illustrated in FIG. 4*a*, is a top view of the pin assembly 50 used to connect beam 14*a* to the plate assembly 20. This view illustrates how the steel pipe 54, with the steel web stiffener 52, is restrained by the cap plates 62, which are then fastened together with a torqued high-strength bolt 60. The bolt is aligned through the hole 56 in the web stiffener 52 and through holes 64 in the opposing cap plates 62. Steel washers 59 are used under the bolt head 58 and the under the end nut 63 to secure the cap plates 62 against the pipe 54.

Figures 5, 5A:
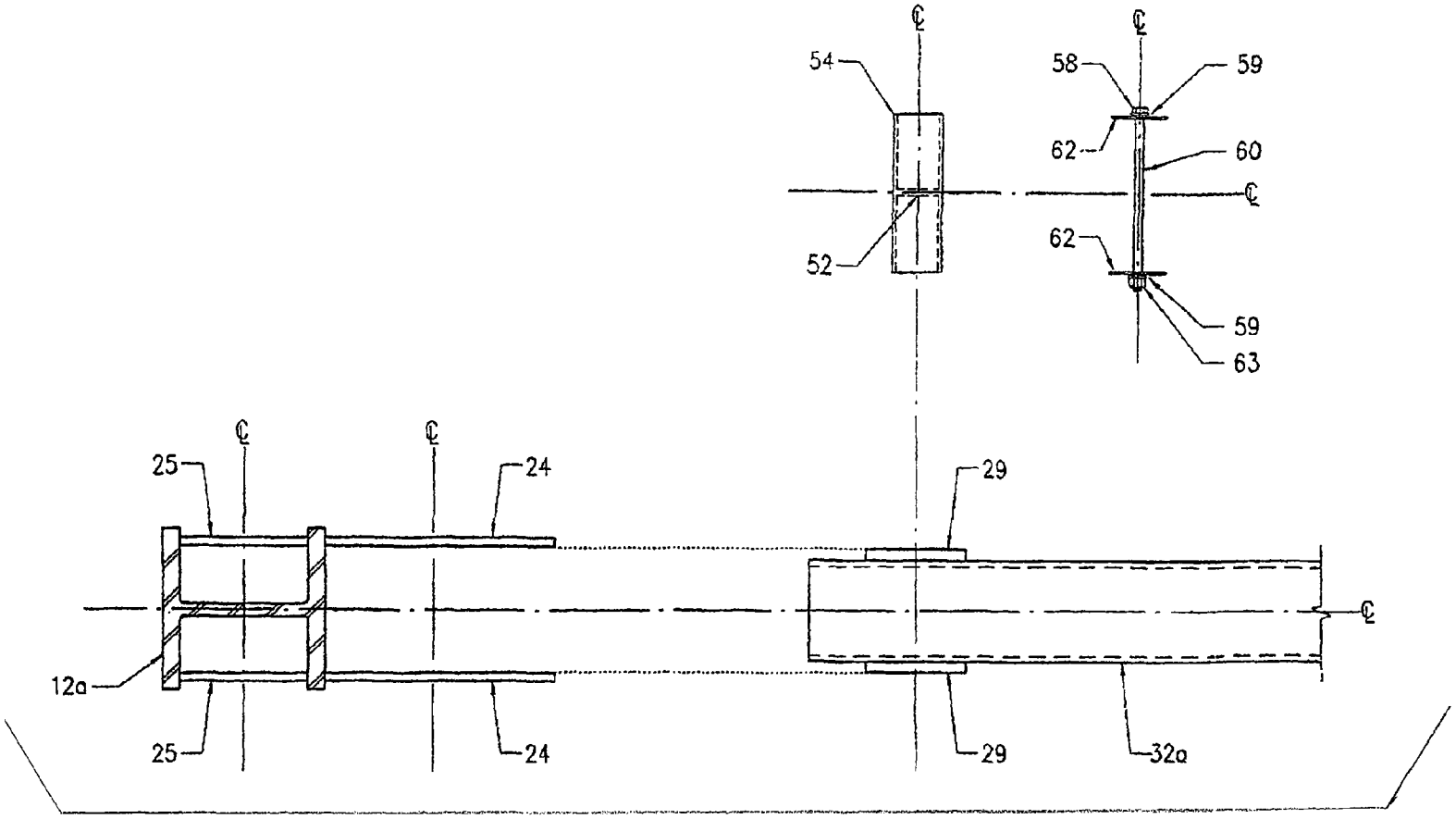
FIG. 5 is an exploded top view of the brace-to-column joint assembly illustrated in FIG. 1.
FIG. 5*a* is a side view of the pipe/pin assembly and the web stiffener used to connect the brace to the plate assembly.

FIG. 5 is an exploded top view of the pin-fuse frame 10 illustrated in FIG. 1 specifically illustrating the brace-to-column connection at joint 20. This view illustrates the placement of connection plates 24 and the diagonal brace 32*a*. As shown in FIG. 5, the connection plates 24 extend outward from the column flanges and toward diagonal brace 32*a* for a connection. In the illustrative example, the connection plates 24 and diagonal brace 32*a* are placed equidistant from one another relative to the center line of the plate assembly.

In the illustrative example, one connection plate 24 is positioned on each side of the diagonal brace 32*a* when the plate assembly 20 and the diagonal brace 32*a* are joined. Stiffener plates 25 are aligned with plates 24 and are located in the web of the column 12*a*. Connection plates 24 and stiffener plates 25 may be welded, or otherwise connected, to column 12*a*. Spacer plates 29 may be placed on the diagonal brace 32*a* to allow for any difference in width relative to the beam 14*a*. Spacer plates 29 may be welded, or otherwise connected, to diagonal brace 32*a*.

Illustrated in FIG. 5*a*, is a top view of the pin assembly 50 used to connect diagonal brace 32*a* to the plate assembly 20. This view illustrates how the steel pipe 54, with the steel web stiffener 52, is restrained by the cap plates 62, which are then fastened together with a torqued high-strength bolt 60. The bolt is aligned through the hole 56 in the web stiffener 52 and through holes 64 in the opposing cap plates 62. Steel washers 59 are used under the bolt head 58 and the under the end nut 63 to secure the cap plates 62 against the pipe 54.

Figure 6:
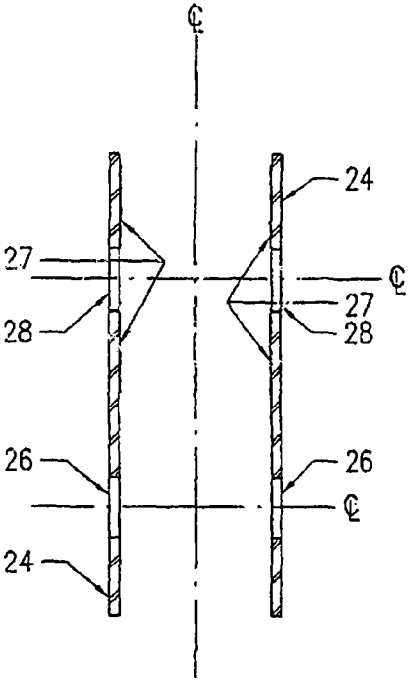
FIG. 6 is a cross sectional view of the plate assembly of FIG. 3 taken along line 6-6'.

FIG. 6 is a cross sectional view of the plate assembly 20 of FIG. 3 taken along line 6-6'. The section illustrates the cross-section of the outer connection plates 24. In addition, this view illustrates the position of the holes 26 and 28 for the diagonal brace 32*a* and beam 14*a* respectively. FIG. 6 also illustrates the position of the brass shims 27 required for the pin-fuse joint in plate assembly 20.

Figure 7:
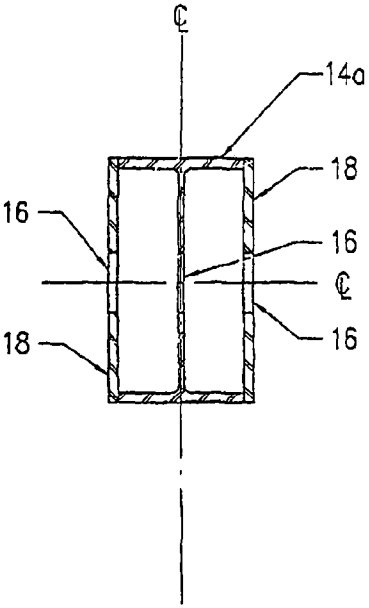
FIG. 7 is a cross sectional view of the moment-resisting beam of FIG. 3 taken along line 7-7'.

FIG. 7 is cross sectional view of the end of beam 14*a* of FIG. 3 taken along line 7-7'. The section illustrates the cross-section of the connection plates 18 and the beam 14*a*. This view illustrates the position of the circular hole 16 relative to the horizontal center line axis of the beam 14*a* taken along line 7-7'.

Figure 8:
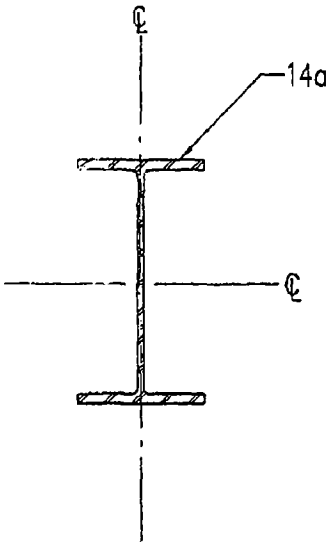
FIG. 8 is a cross sectional view of the moment-resisting beam of FIG. 3 taken along line 8-8'.

FIG. 8 is a cross sectional view of the beam 14*a* of FIG. 3 taken along line 8-8'. This view illustrates the beam 14*a* relative to the centering axis of pin-fuse joint centered on circular hole 16 that aligns with circular hole 28.

Figure 9:
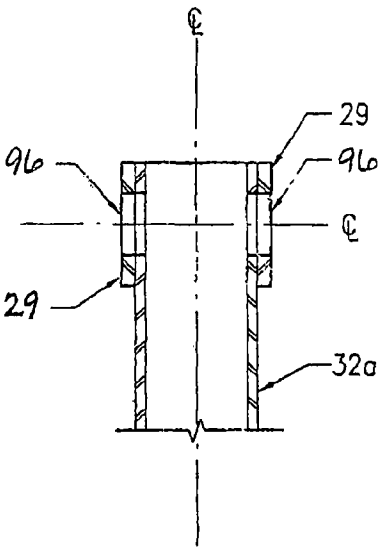
FIG. 9 is a cross sectional view of the brace of FIG. 3 taken along line 9-9'.

FIG. 9 is a cross sectional view of the diagonal brace 32*a* of FIG. 3 taken along line 9-9'. This view illustrates the diagonal brace 32*a* relative to the centering axis of hole 96 that aligns with hole 26 of connection plate 24. FIG. 9 also illustrates spacer plates 29 connected to diagonal brace 32*a* and centered in the centerline axis of plate assembly 20.

Figure 10:
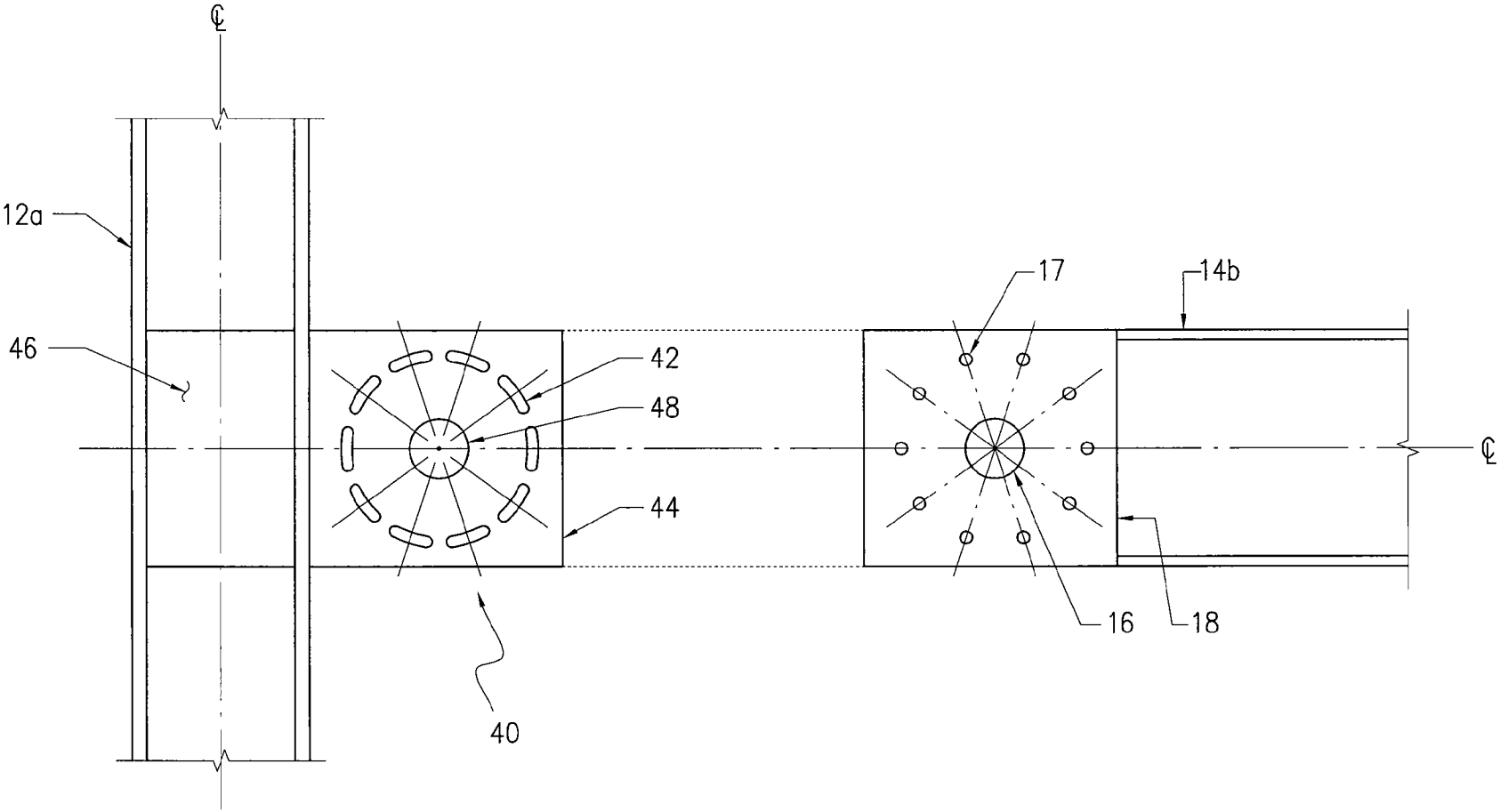
FIG. 10 is an exploded front view of the beam-to-column connection assembly illustrated in FIG. 1.

FIG. 10 is an exploded front view of the pin-fuse frame 10 illustrated in FIG. 1, specifically illustrating the brace-to-column connection at one of the joint assemblies 40. This view illustrates the connection plates 44 and beam 14*a* as they would appear when the joint 40 is disconnected. Connection plates 44 are welded, or otherwise connected, to column 12*a*. Stiffener plates 46 are welded, or otherwise connected, to the column flanges and align with connection plates 44. Connection plates 18 are welded, or otherwise connected, to the flanges of beam 14*b*. Inner holes 16 and 48 are included in connection plates 18 and 44 and in the web of the beam 14*b* to allow for placement of a pin assembly 50. Outer holes 42 with, for example, a radial geometry are formed in connection plate 44. Outer holes 17 are formed in connection plate 18. The outer holes 17 and outer holes 42 are aligned for the installation of connecting rods 70, such as high strength bolts. In the illustrative example, the outer holes 42 are long slotted holes with a radial geometry. One having skill in the art will appreciate that outer holes 17 may alternatively be slotted or may be slotted in addition to the outer holes 42.

Figure 11:
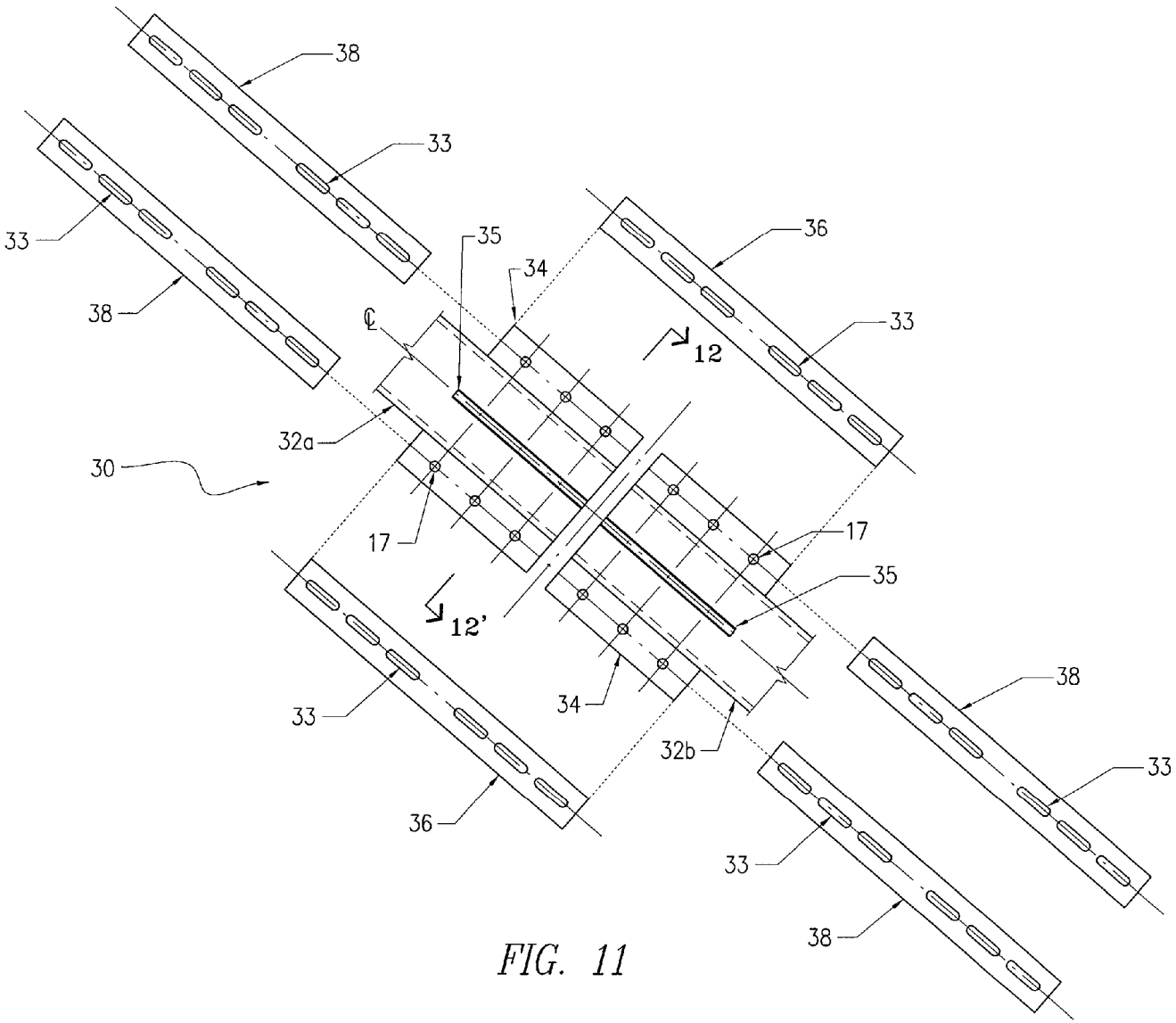
FIG. 11 is an exploded front view of the brace connection assembly illustrated in FIG. 1.

FIG. 11 is an exploded front view of the joint 30 illustrated in FIG. 1. This view illustrates plate assemblies 34, 35, 36, and 38 and diagonal braces 32*a* and 32*b* as they would appear when the joint 30 is disconnected. Plates 34 and 35 are, for example, welded to diagonal braces 32*a* and 32*b*. Plates 36 connect to plates 34, with a plate 36 positioned on at least one side of plate 34. Plates 38 connect to plates 35, with a plate 38 positioned on at least one side of plate 35. Holes 17 are included in plates 34 and 35 and holes 33 are included in plates 36 and 38. These holes are aligned for the installation of high strength bolts 70. In the illustrative example, holes 33 are slot-shaped holes. Alternatively, holes 17 may be slot shaped and holes 33 may be circular, or both holes 17 and 33 may be slot shaped. Further, the illustrative example depicts a plurality of holes 17 that each align to a corresponding hole 33. Alternatively, one or more of the holes 17 or 33 may be a slot that corresponds to multiple corresponding holes. For example, plate 36 may include a single slot 33 that aligns with three holes 17 of plate 34 of brace 32*a* and that aligns with three holes 17 of plate 34 of brace 32*b*, with a bolt 70 passing through the single slot 33 and each of the six holes 17.

Figure 12:
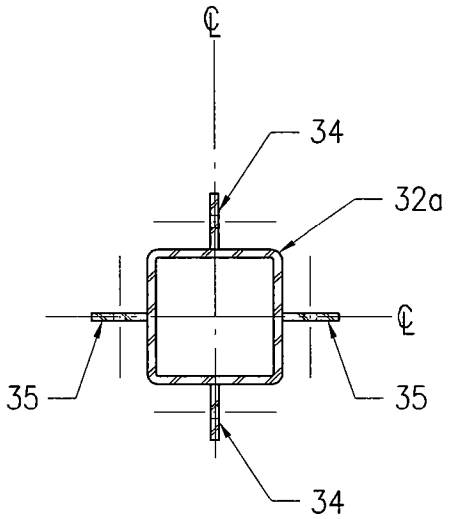
FIG. 12 is a cross sectional view of the brace of FIG. 11 taken along line 12-12'.

FIG. 12 is a cross sectional view of the diagonal brace 32*a* of FIG. 11 taken along line 12-12'. This view illustrates the diagonal brace 32*a* relative to the connection plates 34 and 35 relative to the centering axis of diagonal brace.

Figure 13:
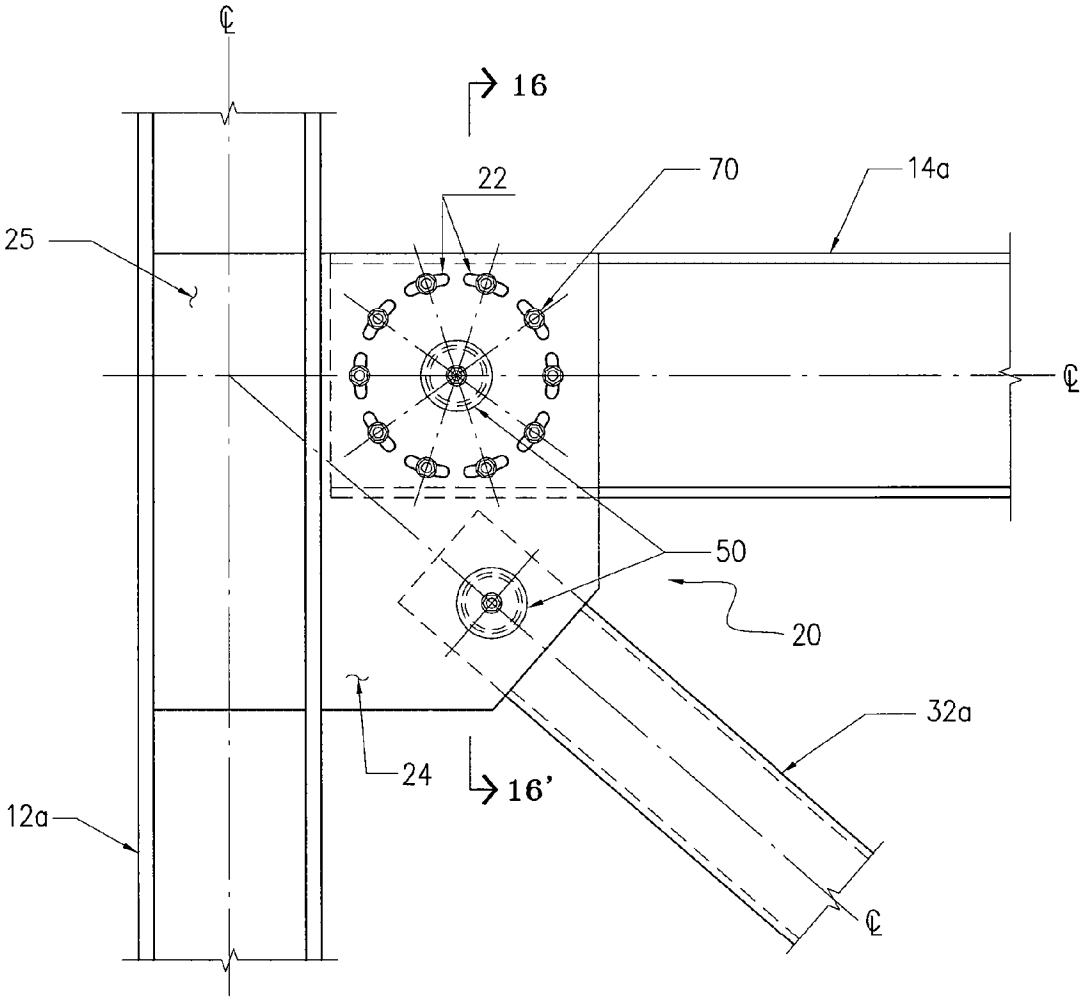
FIG. 13 is a front view of one embodiment of the beam-to-brace-to-column joint assembly consistent with the present invention.

FIG. 13 is a front view of one of the pin-fuse frame 10 joints 20 illustrated in FIG. 1. This view illustrates the connection plates 24, beam 14*a*, and brace 32*a* as they would appear when the joint 20 is fully connected. Connection plates 24 are illustratively welded to column 12*a*. Stiffener plates 25 are welded to the column flanges and align with connection plates 24. Pin assemblies 50 are illustrated in connection plates 24 connecting beam 14*a* and diagonal brace 32*a*. Outer holes 22 with a radial geometry are formed in connection plates 24. High-strength bolts 70 are positioned through the outer holes 22 and secured.

Figure 14:
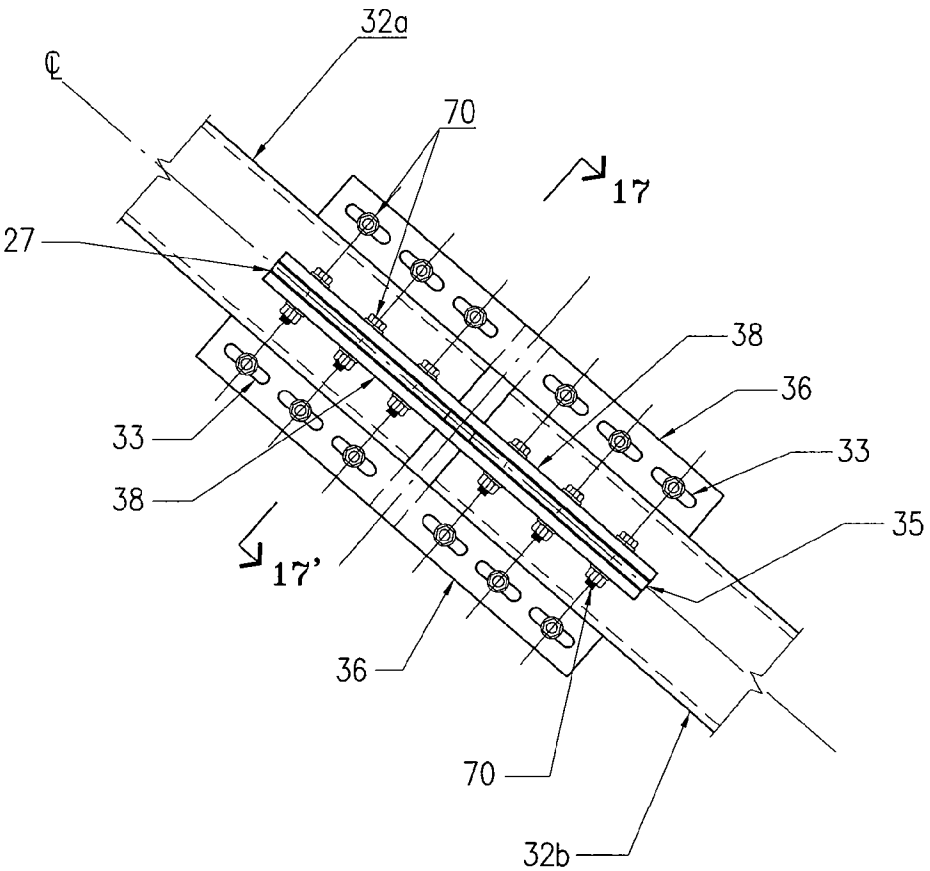
FIG. 14 is a front view of one embodiment of the brace joint assembly consistent with the present invention.

FIG. 14 is a front view of the pin-fuse frame 10 joint 30 illustrated in FIG. 1. This view illustrates the fully connected fuse assembly joint 30 of the diagonal braces 32*a* and 32*b*. Plates 36 and 38 are bolted to plates 34 and 35 respectively. Holes 33 exist in connection plates 36 and 38. Torqued high-strength bolts 70 are used to connect plates 36 and 38 to plates 34 and 35. A brass shim 27 is used between connection plates 34 and 36 as well as 35 and 38.

Figure 15:
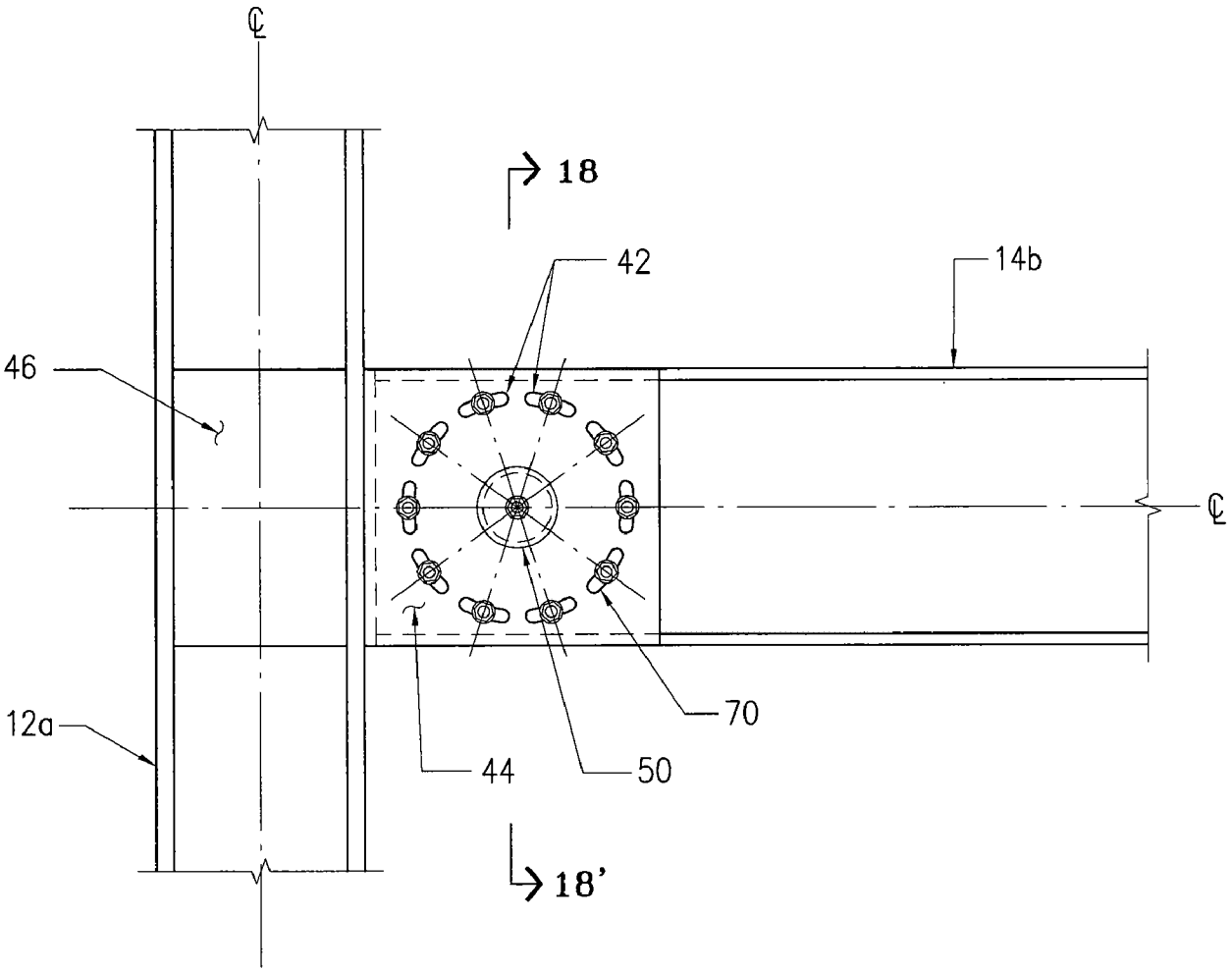
FIG. 15 is a front view of one embodiment of the beam-to-column joint assembly consistent with the present invention.

FIG. 15 is a front view of the pin-fuse frame 10 joint 40 illustrated in FIG. 1. This view illustrates the connection plates 44 and beam 14*b* as they would appear when the joint 40 is fully connected. Connection plates 44 are illustratively welded to column 12*a*. Stiffener plates 46 are illustratively welded to the column flanges and align with connection plates 44. Pin assembly 50 is illustrated in plates 44 connecting beam 14*b* and column 12*a*. Holes 42 with a radial geometry are formed in connection plates 44. High-strength bolts 70 are positioned through holes 42. Holes 17 in the beam connection plates and holes 42 are aligned for the installation of the torqued high-strength bolts 70.

Figure 16:
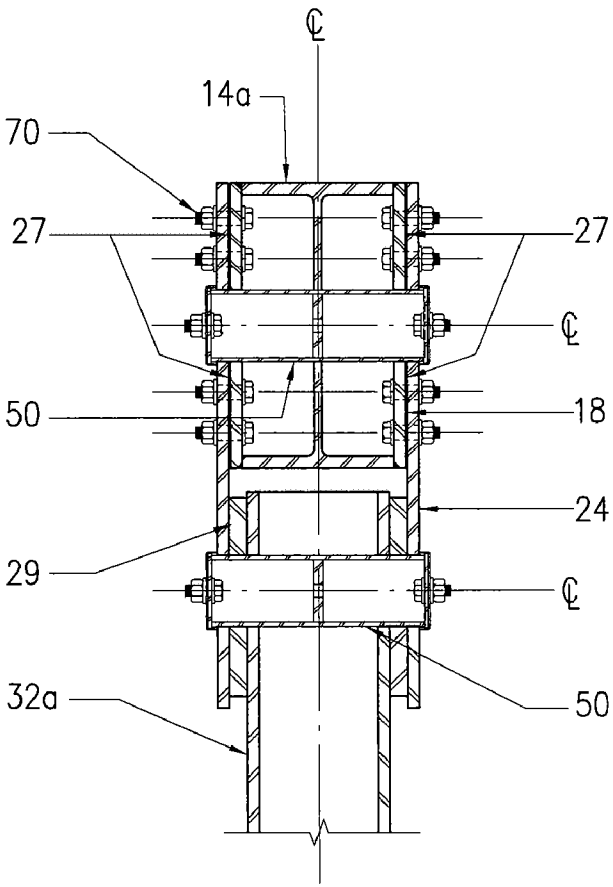
FIG. 16 is a cross sectional view of the moment-resisting beam, brace, and connection assembly of FIG. 13 taken along line 16-16'.

FIG. 16 is a cross sectional view of the joint 20 of FIG. 13 taken along line 16-16'. The section illustrates the cross-section of the outer connection plates 24 and connection plates 18 welded to beam 14*a*, and brace 32*a*. Spacer plates 29 are illustrated and may be used as required to compensate for any dimension difference in width between beam 14*a* and diagonal brace 32*a*. In addition, this view illustrates the pin assemblies 50 used to connect beam 14*a* and diagonal brace 32*a* to connection plates 24. High-strength bolts used to connect plates 18 to 24 as shown in this cross sectional view. FIG. 16 also illustrates the position of the brass shims 27 that may be used for the pin-fuse joint in plate assembly 20.

Figure 17:
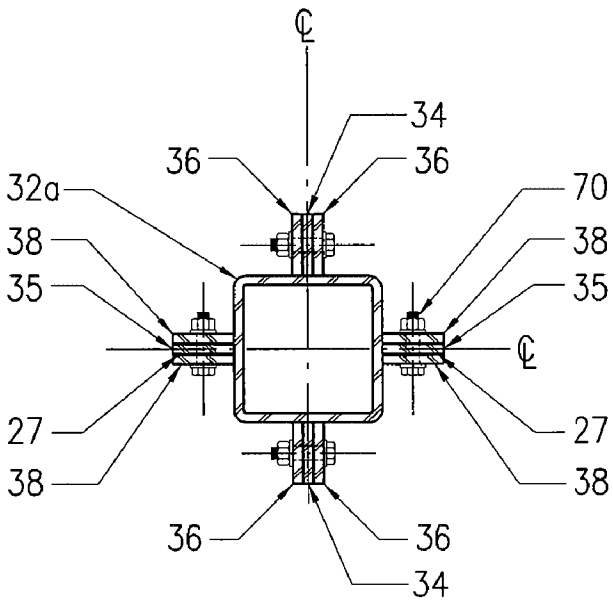
FIG. 17 is a cross sectional view of brace connection assembly of FIG. 14 taken along line 17-17'.

FIG. 17 is a cross sectional view of the diagonal brace 32*a* of FIG. 14 taken along line 17-17'. This view illustrates the diagonal brace 32*a* with plates 34 connected to plates 36 and plates 35 connecting to plates 38 with torqued high-strength bolts 70. Brass shims 27 are shown between connection plates 34 and 36 as well as connection plates 35 and 38. In addition, FIG. 14 illustrates connection plates 34, 35, 36, and 38 relative to the centering axis of the diagonal brace 32*a*.

Figure 18:
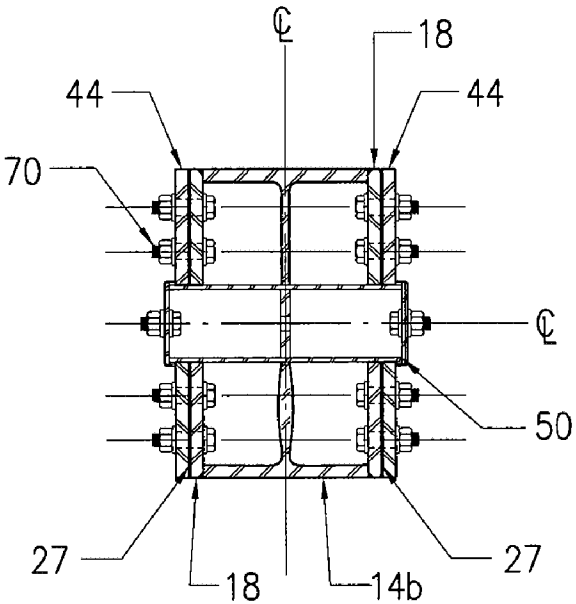
FIG. 18 is a cross sectional view of the moment-resisting beam and connection assembly of FIG. 15 taken along line H-H'.

FIG. 18 is cross sectional view of the end of beam 14*b* of FIG. 15 taken along line 18-18'. The section illustrates the cross-section of the connection plates 18, beam 14*b*, and outer connection plates 44. This view illustrates the position of the pin assembly 50 relative to the horizontal center line axis of the beam 14*b* taken along line 18-18'. In addition, FIG. 18 illustrates the brass shims 27 relative to connection plates 18 and 44. Connection plates 18 and 44 are connected with torqued high-strength bolts 70.

Figure 19:
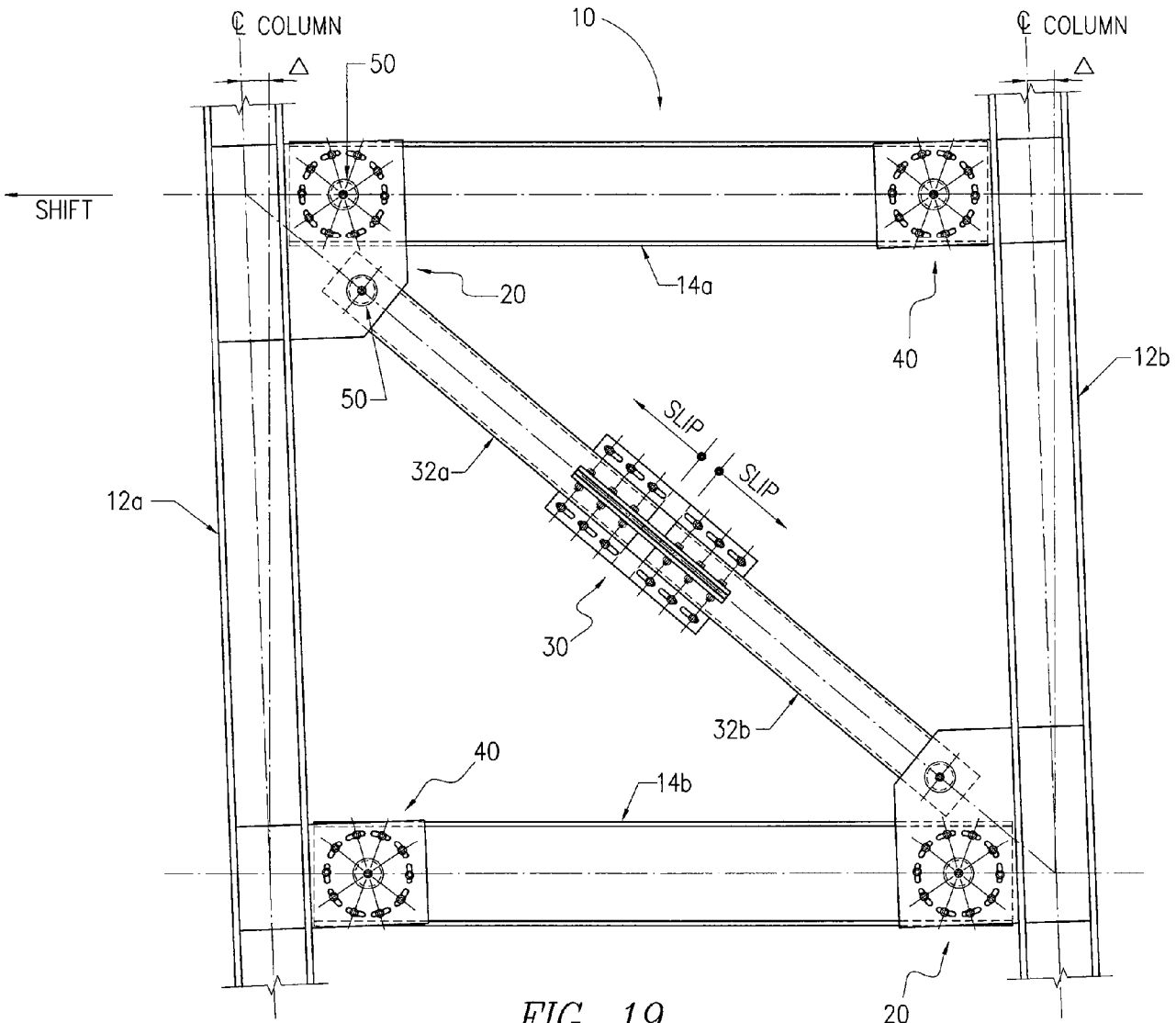
FIG. 19 is a front view of the pin-fuse frame consistent with the present invention as it would appear with the pin-fuse frame laterally displaced when subject to extreme loading conditions.

FIG. 19 is a front view of the pin-fuse frame 10 shown in FIG. 1 and illustrates the pin-fuse frame 10 subjected to lateral seismic loads. Beams 14*a* and 14*b* are shown in a rotated position due to rotation in joints 20 and 40 and diagonal braces 32*a* and 32*b* are shown in an extended position due to slip in the fuse joint assembly 30. Joints 20 and 40 are connected to columns 12*a* and 12*b* with connections to beams 14*a* and 14*b* as well as braces 32*a* and 32*b*. The beams are connected to the columns with pin-fuse connections 20 and 40. The braces are connected to the columns with connections 20. The braces are connected together with a fuse joint 30. Pin assemblies 50 are used to connect beams 14*a* and 14*b* and diagonal braces 32*a* and 32*b* to plate assemblies 20 and 40.

Accordingly, with the slip of the fuse joint 30 in the diagonal brace or the slip/rotation of the pin-fuse joint 20 and/or 40 at the beam ends, energy is dissipated. During typical service conditions, wind loading and moderate seismic events, the bolted pin-fuse connections 20, 30, and 40 are designed to remain fixed. This is accomplished by the clamping forces developed in the high-strength bolted connections. As forces increase, as they would in an extreme seismic event, the bolts 70 are design to slip within the joints. This slip may first occur within fuse joint assembly 30 then within pin-fuse assemblies 20 and 40. Axial forces (either tension or compression) cause slip in the brace connection 30 and bending moments cause slip in the beams at joints 20 and 40. Pins 50 within the beam and brace ends resist shear and provide a well-defined point of rotation. The dynamic characteristics of the structure are thus changed during a seismic event once the onset of slip occurs. This period is lengthened through the inherent softening, i.e., stiffness reduction, of the structure, subsequently reducing the effective force and damage to the structure.

Shims, located between the steel connection plates, control the threshold of slip. The coefficient of friction of the brass against the cleaned mill surface of the structural steel is very well understood and accurately predicted. Thus, the amount of axial load or bending moment required to initiate slip or rotation that will occur between connection plates is generally known. Furthermore, tests performed by the inventor have proven that bolt tensioning in the high-strength bolts 70 is not lost during the slipping process. Therefore, the frictional resistance of the joints is maintained after the structural frame/joint motion comes to rest following the rotation or slippage of connecting plates. Thus, the pin-fuse frame should continue not to slip during future wind loadings and moderate seismic events, even after undergoing loadings from extreme seismic events.

The foregoing description of an implementation of the invention has been presented for purposes of illustration and description. It is not exhaustive and does not limit the invention to the precise form disclosed. Modifications and variations are possible in light of the above teachings or may be acquired from practicing the invention. The scope of the invention is defined by the claims and their equivalents.

For example, other applications of the pin-fuse frame 10 within a structure may include the introduction of the frame 10 into other structural support members in addition to the steel frames, such as the reinforced concrete shear walls. Other materials may be considered for the building frame 10, including, but are not limited to, composite resin materials such as fiberglass. Alternate structural steel shapes may also be used in the pin-fuse frame 10, including, but not limited to, built-up sections, i.e., welded plates, or other rolled shapes such as channels. Alternate connection types may be used for that illustrate in joint assembly 30 including, but not limited to steel tubes placed within steel tubes and through-bolted. Alternative materials (other than brass) may also be used as shims between the connection plates 18 and 24, 34 and 36, and 35 and 38 to achieve a predictable slip threshold. Such materials may include, but not be limited to, Teflon, bronze or steel with, for example, a controlled mill finish. Steel, Teflon, bronze or other materials may also be used in place of the brass shims 27 in the plate end connections.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A joint connection comprising:

a brace assembly positioned diagonally between two columns of a structural frame, the brace assembly having a first brace and a second brace that is separated from the first brace, the first brace having a first brace connection plate affixed to a surface of the first brace and having at least one first hole formed therethrough, the second brace having a second brace connection plate affixed to a surface of the second brace and having at least one second hole formed therethrough;

a connecting plate having at least a third hole and a fourth hole formed therethrough, the third hole aligned with the at least one first hole of the first brace and the fourth hole aligned with the at least one second hole of the second brace, the holes in at least one of the group of the first hole and the second hole and the group of the third hole and the fourth hole being slots aligned in a direction of the first and second braces;

at least one first pin positioned through the at least one first hole and the at least one third hole connecting the first brace to the connecting plate; and at least one second pin positioned through the at least one second hole and the at least one fourth hole connecting the second brace to the connecting plate, the joint connection accommodating a slippage of at least one of the first and second braces relative to each other when the joint connection is subject to a seismic load, wherein, the size of a cross-section of the first brace is the same as that of the second brace, the first brace connection plate has a lower surface affixed to the surface of the first brace and an upper surface opposite the surface of the first brace with the at least one first hole, the at least one first hole used for connecting the first brace and the connecting plate and formed in an area away from the surface of the first brace, and the second brace connection plate has a lower surface affixed to the surface of the second brace and an upper surface opposite the surface of the second brace with the at least one second hole, the at least one second hole used for connecting the second brace and the connecting plate and formed in an area away from the surface of the second brace.

2. The joint connection of claim 1, further comprising:

a shim positioned between the first brace connection plate and the connecting plate.

3. The joint connection of claim 1, further comprising:

a shim positioned between the second brace connection plate and the connecting plate.

4. The joint connection of claim 2, wherein the shim comprises at least one of brass, steel, polytetrafluoroethylene, and bronze.

5. The joint connection of claim 3, wherein the shim comprises at least one of brass, steel, polytetrafluoroethylene, and bronze.

6. The joint connection of claim 1, wherein the first pin and the second pin each comprises one of a threaded steel rod, a plurality of threaded steel rods, and a plurality of high-strength bolts.

7. The joint connection of claim 1, wherein the brace assembly connects to the structural frame via a pin joint at each end of the brace assembly.

8. The joint connection of claim 1, wherein the first brace connection plate is welded to the surface of the first brace, and the second brace connection plate is welded to the surface of the second brace.

* * * * *